United States Patent [19]

Eke

[11] Patent Number: 4,794,219

[45] Date of Patent: Dec. 27, 1988

[54] MICROWAVE OVENS AND METHODS OF COOKING FOOD

[75] Inventor: Kenneth I. Eke, South Croydon, England

[73] Assignee: Microwave Ovens Limited, Shirley, England

[21] Appl. No.: 214,828

[22] Filed: Jul. 5, 1988

Related U.S. Application Data

[63] Continuation of Ser. No. 027,247, Mar. 18, 1987, abandoned.

[30] Foreign Application Priority Data

Mar. 26, 1986 [GB] United Kingdom ..... 8607486
Apr. 1, 1986 [GB] United Kingdom ..... 8607901
Oct. 17, 1986 [GB] United Kingdom ..... 8624938

[51] Int. Cl.[4] ..... H05B 6/68

[52] U.S. Cl. ..... 219/10.55 M; 219/10.55 B; 99/325; 426/243

[58] Field of Search ..... 219/10.55 B, 10.55 M, 219/10.55 E, 10.55 R, 492; 99/DIG. 14, 325, 451; 426/243, 523

[56] References Cited

U.S. PATENT DOCUMENTS 4,379,964 4/1983 Kanazawa et al. ..... 219/492
4,447,693 5/1984 Buck ..... 219/10.55 M
4,481,394 11/1984 Tanabe ..... 219/10.55 R
4,488,026 12/1984 Tanabe ..... 219/10.55 B
4,499,357 2/1985 Kojima ..... 219/10.55 B
4,533,809 8/1985 Eke ..... 219/10.55 B
4,584,448 4/1986 Tanabe ..... 219/10.55 B
4,661,670 4/1987 Eke ..... 219/10.55 B

*Primary Examiner*—Philip H. Leung
*Attorney, Agent, or Firm*—Penrose Lucas Albright; Robert A. Miller

[57] ABSTRACT

A microwave oven having a cavity for receiving a food item to be cooked, a magnetron for delivering microwave power to the cavity, and a forced hot air system including a fan and an electrical resistance heating element which are disposed in a compartment separated from the cavity by a dividing panel. The oven has a thermistor for monitoring the variation of hot air temperature over time and for determining the particular time at which the hot air temperature reaches a predetermined value. When the hot air temperature reaches the predetermined value, a microprocessor: (1) determines the remaining cooking time to complete cooking by referring to an internal program that relates the time of measurement with total cooking time, and (2) determines a maximum hot air temperature to be maintained from the time of measurement to the end of cooking by reference to a second internal program which relates the values of the time of measurement with the maximum desirable hot air temperature.

7 Claims, 6 Drawing Sheets

MICROWAVE OVENS AND METHODS OF COOKING FOOD

This is a continuation application Ser. No. 027,247 filed Mar. 18, 1987, now abandoned.

FIELD OF THE INVENTION

This invention relates to microwave ovens of the type having both a magnetron for delivering microwave power to the oven cavity and a forced hot air system for delivering a forced flow of hot air through the oven cavity. The invention also relates to a method of cooking food in such a microwave oven.

BACKGROUND OF THE INVENTION

The Applicants' UK Patent Specification Nos. 2127658A and 2137860A disclose microwave ovens of this type. In these ovens, control of the cooking process depends upon monitoring the variation of hot air temperature with time. This can vary from individual oven to oven because of manufacturing tolerances and variations in characteristics of components. The invention aims to provide a microwave oven which follows a cooking sequence dependent upon values measured during cooking, so compensating for variations between individual ovens.

SUMMARY OF THE INVENTION

According to one aspect of the invention a microwave oven comprises a cavity for receiving a food item to be cooked, a magnetron for delivering microwave power to the cavity, a forced hot air system including a fan and an electrical resistance heating element which are disposed in a compartment separated from the cavity by a dividing panel, the panel having a first aperture serving as a hot air outlet aperture for the cavity and a second aperture serving as a hot air inlet aperture for the cavity, whereby the fan draws air into the compartment from the cavity through the outlet aperture, directs the air over the heating element and thence returns the air to the cavity through the inlet aperture, means for monitoring the variation of hot air temperature with time and determining the particular time at which the hot air temperature reaches a predetermined value, and means at said particular time for:

(1) determining the remaining cooking time, beyond said particular time to the end of cooking, by reference to a first pre-set characteristic relating the values of said particular time with the values of total cooking time, and (2) determining a maximum hot air temperature for controlling the hot air temperature from the particular time to the end of cooking, by reference to a second preset characteristic relating the values of said predetermined time with the maximum hot air temperature.

The determination of the maximum hot air temperature in (2) above is preferably done thermostatically.

The means for monitoring the variation of the hot air temperature with time preferably comprises a thermistor located adjacent the fan. The latter is conveniently mounted immediately behind the hot air outlet aperture, and may have a horizontally rotatable impeller with a plurality of blades angularly spaced around the impeller and operative to draw air into the compartment and thence force the air over the resistance heating element to heat the air. The temperature sensor is preferably located substantially midway between the outer periphery of the fan and the adjacent wall of a casing which defines the margin of the compartment.

The thermostatic control may be effected with the aid of a second thermistor located adjacent the inlet aperture to the cavity, preferably just downstream of the heating element.

The oven may have the facility of producing a well done or a lightly done result, in addition to the normal result, in which case the first and second characteristics are altered to produce, in the case of the user requiring a well done result, a longer remaining cooking time and a higher maximum hot air temperature or, in the case of the user requiring a lightly done result, a shorter remaining cooking time and a lower maximum hot air temperature.

The oven may have the facility of selecting one program for ordinary baked items, excluding cakes, and another program for frozen foods and cakes. In this case the oven stores first and second characteristics suitable for said one program and first and second characteristics suitable for said another program.

The various control functions are conveniently carried out by a microprocessor connected to the thermistors and operative to control energisation of the magnetron and the hot air system.

To obtain repeatable results, the oven should commence from a cold condition, which in practice means less than about 80° C.

This is done in the Applicants UK specifications Nos. 2127658A and 2137860A by venting the oven cavity at the commencement of a subsequent cooking operation, the air from the magnetron blower motor being directed through the cavity until a thermostat in the forced air path registers that the temperature has fallen to the "cold start" temperature of 80° C., after which cooking is initiated by the simultaneous application of microwave power and hot air. However, certain metal parts of the oven will still be quite warm when cooking is initiated, and this residual warmth causes the thermostat to reach a predetermined threshold temperature (at which the oven switches off automatically as described in No. 2137860A) in a shorter time than for a genuine cold start. Hence, for any particular food item the cooking time as automatically determined by the oven tends to be less for a warm start than for a cold start. This can cause the food item to be less well cooked if it is cooked after a warm start than after a genuine cold start, and the following preferred feature of the invention aims to correct this variation.

According to this preferred feature of the invention the oven has means for forcing cold or cool air through the cavity in order to cool the latter during a cool down period before a subsequent cooking operation, a thermostat to determine the temperature of the air flow and means for terminating the cool down period and initiating the cooking operation by the simultaneous application of forced hot air and microwave power when the air flow temperature drops to a cool down temperature, and wherein microwave power is applied to the cavity during the cool down period.

In the preferred embodiment the cool or cold air is blown through the cavity by directing air from a magnetron cooling fan into the cavity during the cool down period.

The invention also includes within its scope a method of cooking food in a microwave oven according to the said one aspect.

A microwave oven forming a preferred embodiment of the invention will now be described by way of example with reference to the accompanying drawings, in which.

Figure 4:
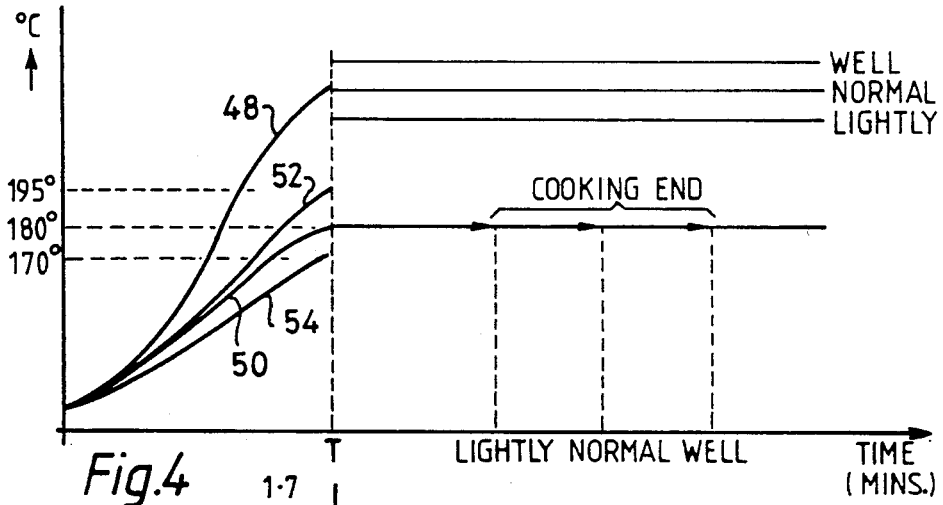
FIG. 4 is a graph showing the variation of hot air temperature with time, for ordinary baked items excluding cakes.
Figure 5:
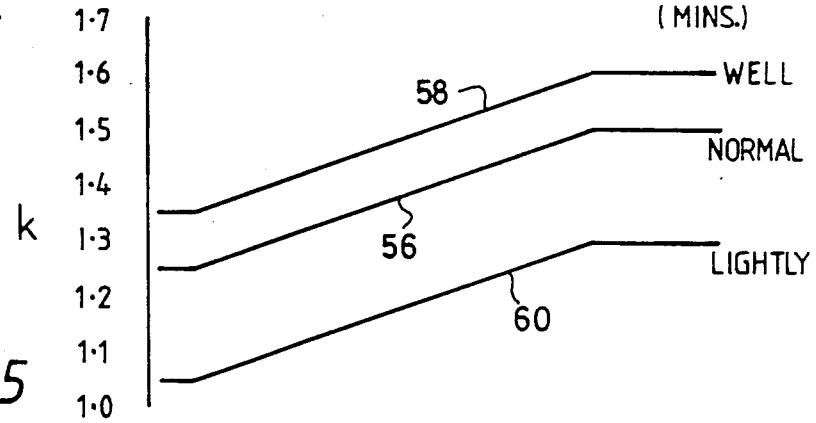
Figure 6:
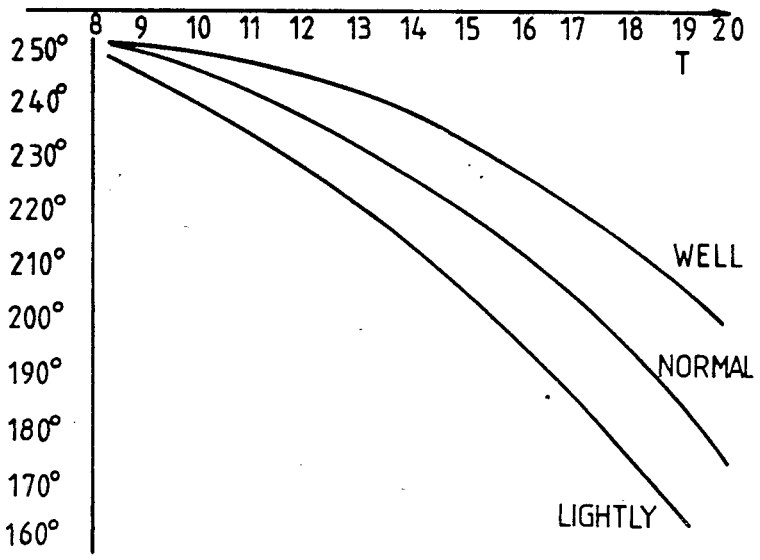
Figure 7:
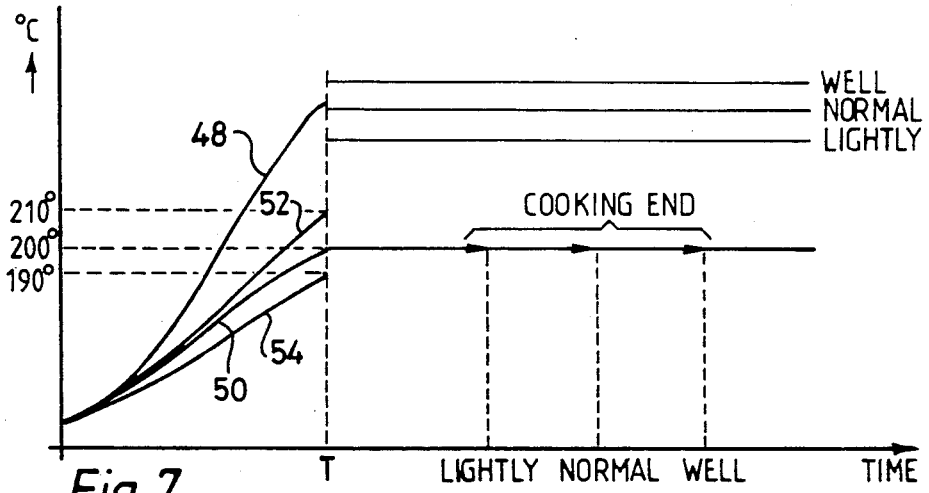
Figure 8:
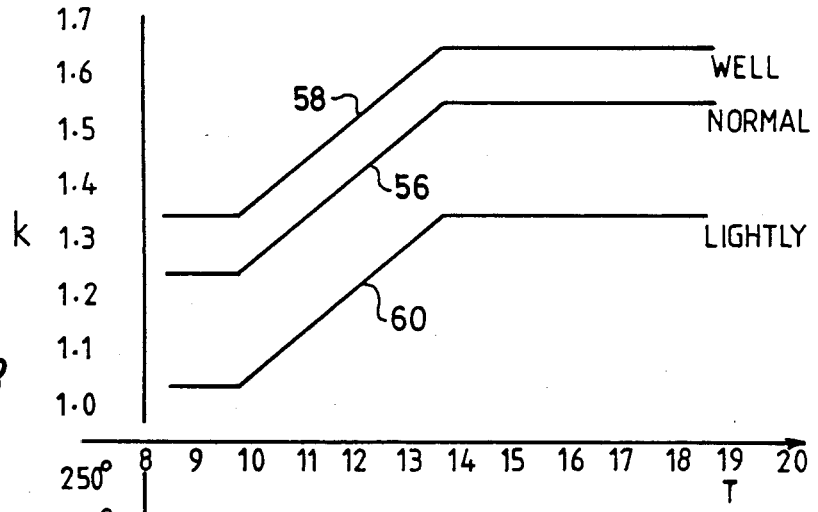
Figure 9:
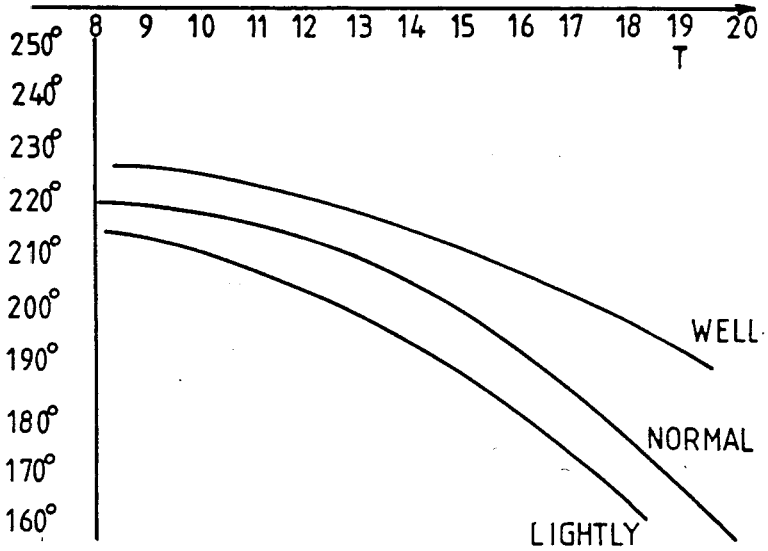
Figure 10:
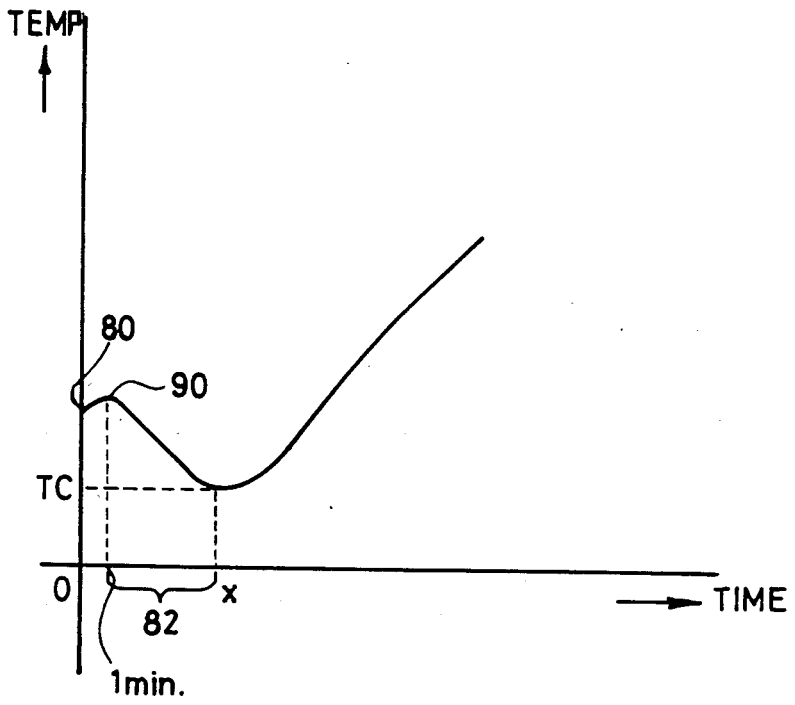

FIGS. 5 and 6 are graphs showing first and second characteristics stored in the microprocessor of the oven for ordinary baked items excluding cakes, FIGS. 7, 8 and 9 correspond to FIGS. 4, 5 and 6, but apply to the cooking of frozen foods and cakes, and FIG. 10 is a graph showing how the cavity is cooled down before a further cooking operation.

The oven is similar in construction and in circuit configuration to the ovens disclosed in the applicants' two aforementioned UK patent specifications. In particular, the oven has a food-receiving cavity 10 which is closable by a hinged front door 12 and in the base of which is located a rotatable turntable 14. A magnetron (not shown) delivers microwave power to the cavity through an inlet 16, and cooling air from a magnetron blower fan is capable of entering the cavity through a perforated inlet 18. The rear panel 20 of the cavity has a perforated outlet aperture 22 and a perforated inlet aperture 24, these two apertures respectively serving for the exit and entry of forced air to the cavity. The cavity has a further vent 25, a perforated area 26 which is illuminated, and the front of the casing of the oven has a control panel 30.

Figure 1:
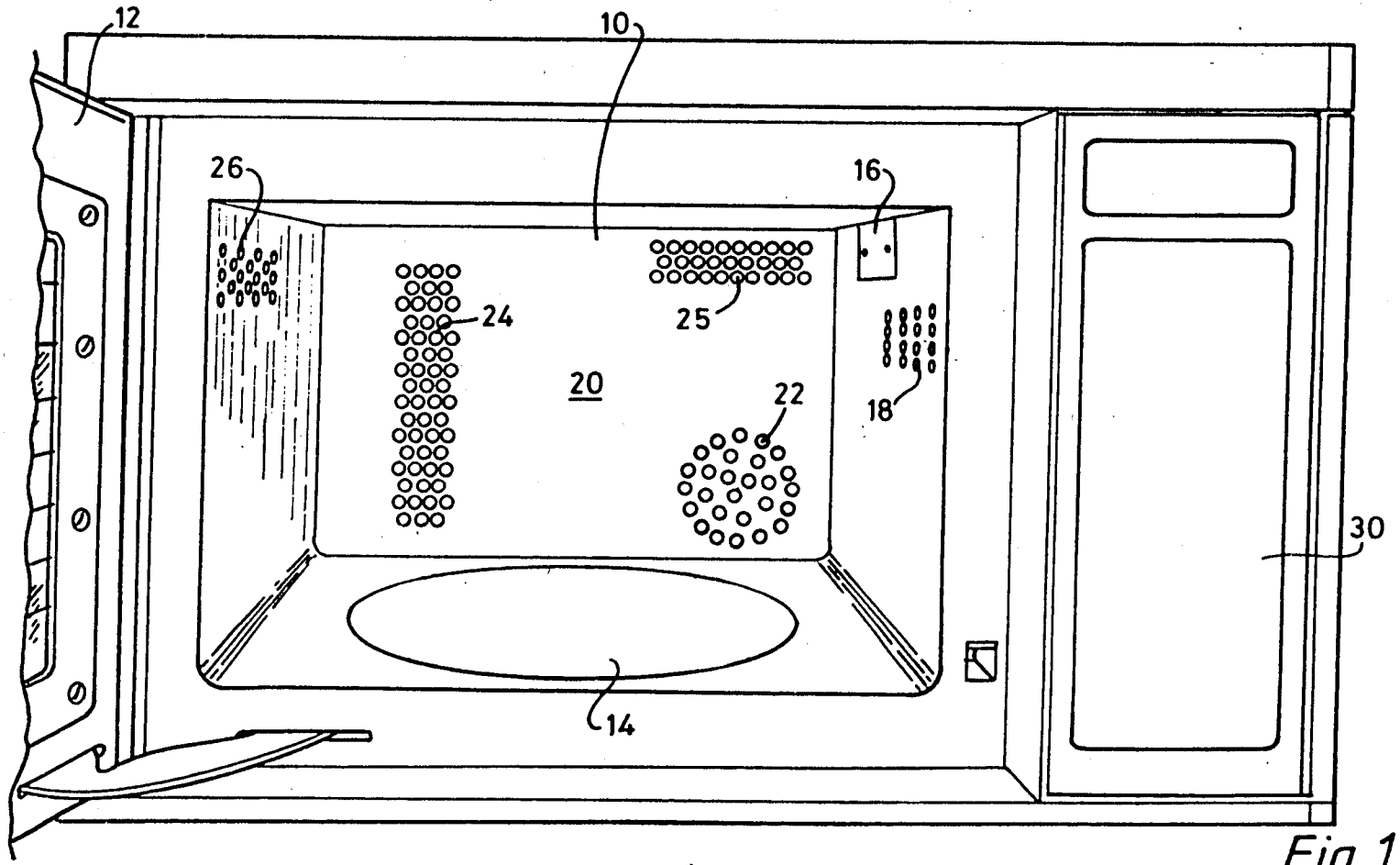
FIG. 1 is a front perspective view of the oven with an oven door open.
Figure 2:
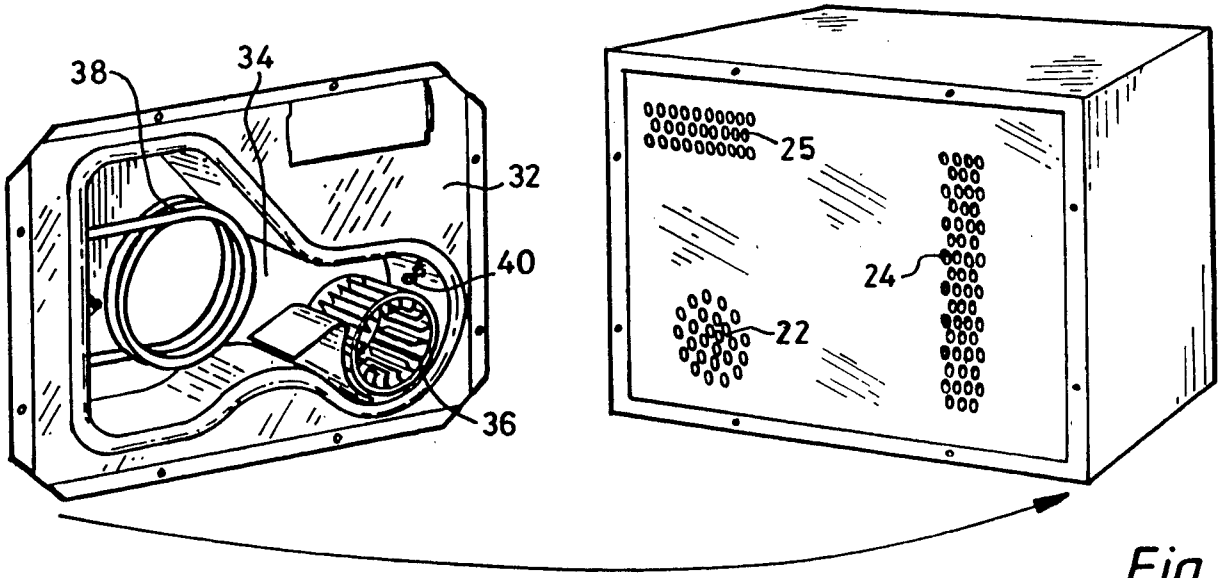
FIG. 2 shows the rear of the oven with a rear panel removed to show a hot air compartment of the oven.
Figure 3:
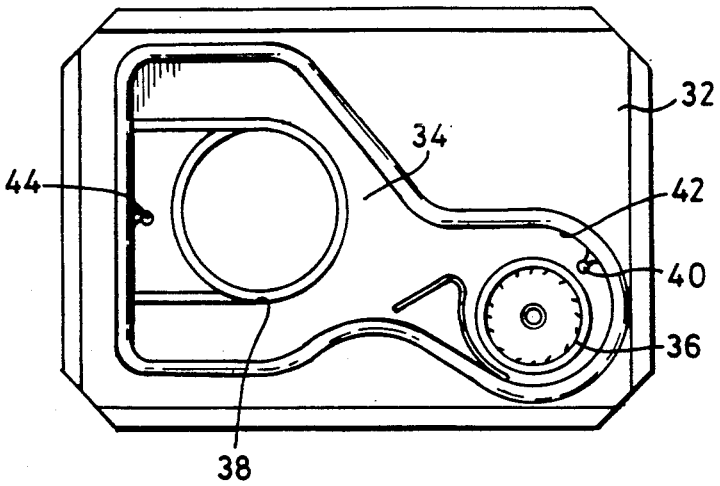
FIG. 3 is an elevation showing the casing and associated elements defining the hot air compartment.

Referring to FIGS. 2 and 3, the rear of the oven has a casing 32 shaped to provide a hot air compartment 34 through which air passes behind the panel 20. Within the compartment 34 are located a fan 36, disposed behind the outlet aperture 22, and an electrical resistance heating element 38, disposed behind the inlet aperture 24. The fan 36 is rotatable about a horizontal axis and has around its periphery a plurality of impeller blades which draw air from the cavity 10, through the outlet aperture 22, and thence force the air over the electrical resistance heating element 38 where it is heated, before redirecting the air back into the cavity 10 through the inlet aperture 24.

A temperature sensor in the form of a thermistor bead 40 is located in the compartment 34 at a position spaced midway between the outer periphery of the blades of the fan 36 and the adjacent wall 42 defining the peripheral margin of the hot air compartment in this region. It will be seen from FIG. 3 that the thermistor bead 40 is located at an angle of about 45° from a vertical line passing through the rotational axis of the fan 36. A further thermistor bead 44 is located in a conventional position just downstream of the electrical resistance heating element 38. Signals from the two thermistor beads 40, 44 provide an accurate indication of cooking progress and the variations of temperature with time, as detected by the two thermistor beads 40, 44, are used by the microprocessor of the oven in order to control the lengths and durations of the microwave power and hot air power, in a manner now to be described.

Referring to FIG. 4, the curve 50 shows the variation of hot air temperature, as detected by thermistor bead 40, plotted against cooking time. Curve 50 applies for nominal mains voltage. Curves 52 and 54 apply if the voltage is +6% or −6% respectively of the nominal voltage. When the thermistor bead 40 records a predetermined value of hot air temperature of 180° C., the corresponding time T is noted by the oven microprocessor. At the particular time T the microprocessor refers to the characteristics of FIGS. 5 and 6 in order to determine the remaining cooking time from FIG. 5 and the maximum hot air temperature for thermostatically controlling the hot air temperature as detected by the thermistor bead 44, by reference to the second characteristic of FIG. 6.

The vertical scale of FIG. 5 is the factor k by which the particular time T must be multiplied to give the total cooking time. The curves of FIGS. 5 and 6 are preprogrammed into the microprocessor. Curve 48 in FIG. 4 shows the temperature variation as detected by the thermistor 44, but there is no thermostatic control of the hot air temperature as detected by the thermistor 44 between time zero and time T.

For example, if the thermistor bead 40 reaches the predetermined value of 180° C. at the particular time T of 12 minutes the microprocessor refers to the graph of FIG. 5 to determine that the total cooking time is 1.3 times 12 minutes (i.e. 15.6 minutes), by reference to the characteristic 56. If the user requires a well done result or a lightly done result, the microprocessor refers to curve 58 or 60, respectively. Cooking continues, at the same levels of microwave power and hot air power, from the particular time of 12 minutes to the end of cooking at 15.6 minutes, at which the microprocessors turns off the magnetron and the hot air power and signals the end of cooking. There is thus a remaining cooking time of 3.6 minutes after the particular time of 12 minutes. Also at the particular time of 12 minutes the microprocessor determines the maximum hot air temperature from FIG. 6 which, in this example, is about 235° C. for a normal result. Hence, the hot air temperature (as detected by the thermistor bead 44) is limited to a maximum of 235° C. for the remaining cooking time of 3.6 minutes, i.e. the interval from the particular time T of 12 minutes to the end of cooking at 15.6 minutes. Hence, thermostatic control is applied over the interval from the particular time T to the end of cooking.

FIGS. 4, 5 and 6 are for ordinary baked items excluding cakes. FIGS. 7, 8 and 9 are corresponding graphs for frozen foods and cakes, and the same reference numerals are used for equivalent features.

For an oven for the Japanese market, where the domestic plug/socket can taken only a limited power, it may be preferable to reduce the microwave power to a very low level and increase the hot air power at the particular time T.

When a cooking operation is completed a damper or shutter moves in order to direct air from the magnetron cooling fan into the oven cavity in order to cool the latter. Even so, metal parts of the cavity may still be warm and this residual warmth is compensated for as illustrated in FIG. 10. After 1 minute of the cooking time has elapsed, the temperature sensed by the thermistor 40 is checked by the thermistor. If this temperature is above a particular cool down temperature TC, automatic cool down is initiated. If the temperature detected by the thermistor 40 is below the particular cool down temperature, normal cooking proceeds.

When the air temperature falls to TC during automatic cool down this signifies the termination of the cool down period, the shutter moves to prevent further air from the magnetron fan entering the cavity and the cooking operation commences with the simultaneous application of microwave power and forced hot air. Cooking then proceeds as described.

Mircrowave power is applied to the cavity during the cool down period. This compensates for the fact that the cooking operation is likely to last for a shorter period of time (in comparison with a cold start) because of the residual heat in the metal parts surrounding the oven cavity.

Referring to FIG. 10, point 80 on the graph indicates the food being placed in the oven cavity (at the time datum) which is warm as the result of a preceding cooking operation. Point 90 is determination of the thermistor temperature 40 after 1 minute. Assuming this temperature to be above the particular cool down temperature TC, automatic cool down is initiated and cool air from the magnetron blower is directed into the oven cavity and microwave power is simultaneously applied throughout a cool down period 82. The thermistor 40 monitors the air temperature and when this drops to the particular cool down temperature TC, (e.g. 80° C.) the cool down period 82 terminates (at time x) and the cooking operation commences.

It will be appreciated that the hotter the cavity at point 90 the longer will be the cool down period 82. The metal parts will also be warmer giving rise to a shorter cooking time, for which compensation is provided by the longer cool down period.

I claim:

1. A microwave oven, comprising: a cavity for receiving a food item to be cooked; a magnetron for delivering microwave power to the cavity; a forced hot air system including a fan and an electrical resistance heating element which are disposed in a compartment separated from the cavity by a dividing panel, said panel having a first aperture as a hot air outlet aperture for said cavity and a second aperture serving as a hot air inlet aperture for said cavity, whereby said fan draws air into said compartment from said cavity through said outlet aperture, directs the air over said heating element and then returns the air to said cavity through said inlet aperture; a first thermistor located adjacent to said fan for monitoring the variation of air temperature over time and determining the time at which the air temperature reached a predetermined value and, when the air temperature reached the predetermined value, means for:

(1) determining the remaining cooking time, beyond the time when the air temperature reached the predetermined value to the end of the cooking by reference to a first stored pre-set characteristic that in combination with the time when the air temperature reached the predetermined value permits a determining of total cooking time, and (2) determining a maximum air temperature for air entering the oven through said hot air inlet aperture from the time when the temperature reached the predetermined value to the end of cooking, the determination being made by reference to a second stored pre-set characteristic using the time when the temperature reached the predetermined value to determine the maximum hot air temperature, said maximum hot air temperature being thermostatically measured and controlled by a second thermistor adjacent said inlet aperture to said cavity, immediately downstream of said heating element.

2. A microwave oven according to claim 1, wherein said first thermistor is located substantially midway between the outer periphery of said fan said an adjacent wall of a casing which defines the margin of said compartment.

3. A microwave oven according to claim 1, wherein the oven has the capability of producing a well done or a lightly done result, in addition to the normal result, based upon the time at which the predetermined temperature value is reached and the desired result, the stored first and second characteristics are adjusted to produce, in the case of the user requiring a well done result, a longer remaining cooking time and a higher maximum hot air temperature or, in the case of the user requiring a lightly done result, a shorter remaining cooking time and a lower maximum hot air temperature.

4. A microwave oven according to claim 1, wherein the oven has means for selecting a first program for ordinary baked items, excluding cakes, and a second program for frozen foods and cakes, the oven storing first and second characteristics data suitable for each said first and second programs such that additional cooking time, beyond the time when the temperature reaches the predetermined value, can be determined as can the maximum temperature.

5. A microwave oven according to claim 1, wherein the oven has means for forcing cold or predetermined cool air through said cavity in order to cool said cavity during a cool down period before a subsequent cooking operation, a thermostat to determine the temperature of the air flow and means for terminating the cool down period and initiating the cooking operation by the simultaneous application of forced hot air and microwave power when the air flow temperature drops to a predetermined cool down temperature, and wherein microwave power is applied to the cavity during the cool down period.

6. A microwave oven according to claim 5, wherein the cool or cold air is blown through said cavity by directing air from a magnetron cooling fan into said cavity during the cool down period.

7. A method of cooking food in a microwave oven having a forced hot air system including a fan and an electrical resistance heating element, comprising the steps of:

delivering microwave power to a cavity of the oven by means of a magnetron for the entire cooking period;

flowing air into the cavity from said hot air system measuring the time necessary for the air, as drawn from said cavity, to reach a predetermined temperature;

calculating, using said time for the air to reach a predetermined temperature, remaining cooking time to complete cooking and a maximum air temperature for hot air entering said cavity;

monitoring the air temperature as drawn from said cavity from said time for the air to reach a predetermined temperature until completion of cooking to control said electrical resistance heating element for raising said air temperature to no more than said maximum air temperature prior to reintroducing the air into said cavity; and shutting of said microwave power and hot air flow at the end of said entire cooking period.

* * * * *